US005401183A

United States Patent [19]

Tan et al.

[11] Patent Number: 5,401,183

[45] Date of Patent: Mar. 28, 1995

[54] HOLDING DEVICE FOR EASY INSTALLATION OF SLIDE LATCH ON THE BACKPANEL CONNECTOR

[75] Inventors: Haw-Chan Tan; Frank C. Ma, both of Diamond Bar, Calif.

[73] Assignee: Genrife Company Limited, Hong Kong

[21] Appl. No.: 134,372

[22] Filed: Oct. 12, 1993

[51] Int. Cl.[6] ..... H01R 4/50

[52] U.S. Cl. ..... 439/347; 439/362; 439/135

[58] Field of Search ..... 439/345, 347, 359, 135, 439/149, 361, 362; 29/739, 747, 764

[56] References Cited

U.S. PATENT DOCUMENTS

| | | | |
|---|---|---|---|
| 4,050,769 | 9/1977 | Ammon | 439/79 X |
| 4,861,276 | 8/1989 | Muller et al. | 439/347 X |
| 5,192,222 | 3/1993 | Krause et al. | 439/347 |
| 5,209,677 | 5/1993 | Bricaud | 439/607 |

*Primary Examiner*—Khiem Nguyen

[57] ABSTRACT

A holding device (10) includes an elongated base (12) and two raised platforms (14, 16) respectively position at two opposite ends thereof. A central cavity (27) is formed in the base for reception of the protrusion portion (62) of the I/O connector (60) therein, and two retaining holes (17) respectively provided approximate or in the platforms extend perpendicular to the holding device (10) for reception of the corresponding screws (50), respectively. The holding device (10) can be attached to and hold the slide latch (30) by its resilience to combine these two components as one unit, and two screws (50) are also temporarily retained in the retaining holes (17) of the holding device (10) by the resilience of the holding device. Therefore, the operator of the computer manufacturer can hold this pre-assembled unit by one hand, and use the screw driver by another hand to rotationally insert the screws (50) into the screw holes (64) in the corresponding I/O connector (60) for fastening the slide latch (30) and the connector (60) to the backpanel of the computer case.

9 Claims, 4 Drawing Sheets

HOLDING DEVICE FOR EASY INSTALLATION OF SLIDE LATCH ON THE BACKPANEL CONNECTOR

BACKGROUND OF THE INVENTION

1. Field of The Invention

The invention relates to an auxiliary device for easy assembling the computer, especially to holding means for temporarily joining a pair of screws with a slide latch as one unit for easy fastening to a connector mounted to the backpanel of the computer.

2. The Prior Art

It is seen that many I/O ports are positioned on the backpanel or backplane of the computer to communicate with external peripherals through the connectors mounted on such backpanel. In the traditional connection, clips are used in such I/O connectors to secure other complementary connectors thereto which are connected to the corresponding peripherals, respectively. Clip structure used with the I/O connector can be found in U.S. Pat. Nos. 4,671,594, 4,721,473, 4,874,336, 4,904,202 and 5,004,430. In the recent years, Local Area Network (LAN) became more popular wherein the slide latch, which functions somewhat as the clip, is presented to latchably attach a peripheral connector to the corresponding I/O connector mounted on the backpanel, and has become standardized as shown in pages 3893 through 3896 of International standard ISO 8802-3 ANSI/IEEE Std 802.3 published on Feb. 24, 1989.

Unlike the clips which are manufactured associated with the I/O port connector and have already been unitary portions of the connector, the slide latch is a separate component with regard to the I/O connector before both such I/O connector and slide latch are fastened to the backpanel of the computer case. It is understood that in the aforementioned situation, such I/O connector is only fastened on add-on card, which is positioned inside the backpanel, but has not been secured to the backpanel. It has been experienced by the operator of the computer manufacturer who assembles the whole computer including these two components, i.e., the slide latch and the connector, that it is a little difficult to quickly or easily implement this job. It is because the operator needs to use the left hand to simultaneously hold the slide latch in position with regard to the I/O connector and hold the screw in alignment with the corresponding screw hole of the I/O connector, and then use the right hand to insert such screw into the screw hole by means of a screw manual/electrical driver. Because the screw used in the computer is too small to hold, sometimes, using the fingers of a single (left) hand can not efficiently and simultaneously have both the separate slide latch and screw(s) placed in position without struggling.

Therefore, an object of the present invention is to provide means which can temporarily hold or combine the slide latch and screws together to form one unit wherein the screws are in position ready to enter and to be in alignment with the screw holes in the I/O connector so that the operator can easily hold such pre-assembled unit by one hand, and use another hand to operate the screw driver to insert the screws of such unit into the screw holes of the I/O connector for fastening the slide latch and the connector to the backpanel of the computer case.

Another object of the present invention is to provide the aforementioned holding means wherein such holding means can be function as a dust-cover to protect the inner I/O connector when no peripheral connector is connected thereto.

SUMMARY OF THE INVENTION

According to the invention, the holding device includes an elongated base and two raised platforms respectively position at two opposite ends thereof. A central cavity is formed in the base for reception of the protrusion portion of the I/O connector therein, and two retaining holes respectively provided approximate or in the platforms extend perpendicular to the holding device for reception of the corresponding screws, respectively. The holding device can be attached to and hold the slide latch by its resilience to combine these two components as one unit, and two screws are also temporarily retained in the retaining holes of the holding device by the resilience of the holding device. Therefore, the operator of the computer manufacturer can hold this pre-assembled unit by one hand, and use the screw driver by another hand to rotationally insert the screws into the screw holes in the corresponding I/O connector for fastening the slide latch and the connector to the backpanel of the computer case.

DETAILED DESCRIPTION OF THE EMBODIMENTS

References will now be made in detail to the preferred embodiments of the invention. While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
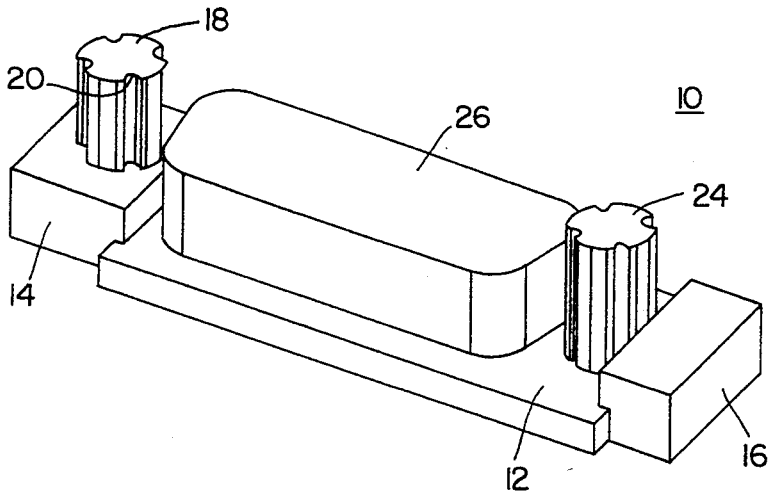
FIG. 1 is a top perspective view of a holding device of a presently preferred embodiment according to the present invention.
Figure 2:
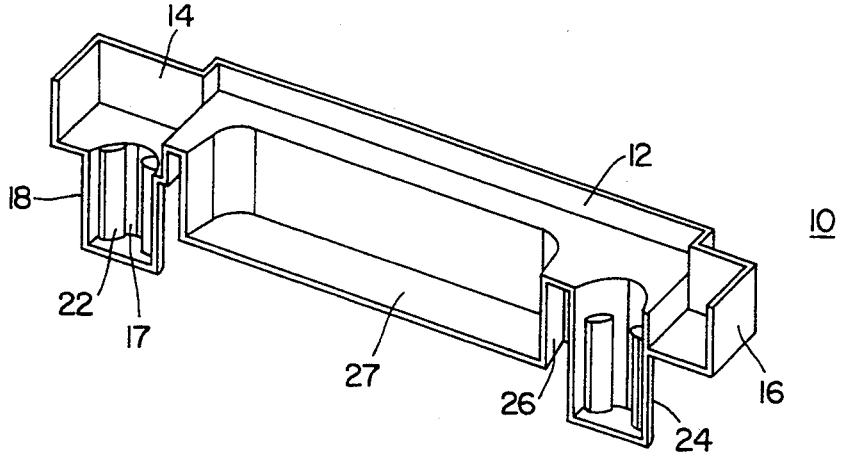
FIG. 2 is a one half bottom perspective view, cut along the centerline lengthwise, of the holding device of FIG. 1 to show the hollow structure thereof.

It will be noted here that for a better understanding, like components are designated by like reference numerals throughout the various figures. Attention is now directed to FIGS. 1 and 2 where the holding device generally designated 10, is manufactured by vacuum forming with a PVC plate having 0.015" thickness. That is, the holding device 10 has a form of hollow type like many plastic products wherein, like a mask, the bottom side thereof is open to the exterior.

The holding device 10 includes an elongated base 12, a large first platform 14 and a second small platform 16 raised at two opposite ends, respectively. The platforms 14, 16 are somewhat narrower than the base 12 to conform the shape of the slide latch which will described later. A first hollow post 18 extends upward from the large platform 14 a first distance, and four recesses 20 are formed at equal intervals around the periphery of the post 18 and along the whole length thereof. In contrast, four ribs 22 are correspondingly formed around the retaining hole 17 or the interior of the post 18 for retaining a screw therein. Similarly but oppositely, a second post 24 extends to the same height upward from the outermost portion of the base 12 approximate the small platform 16 for retaining another screw therein.

An island section 26 extends a second distance upward from the base 12 and between the posts 18 and 24 to form an internal cavity 27 for conformably reception of the protrusion portion of an I/O connector which the holding device 10 and the slide latch will be attached to.

Figure 3:
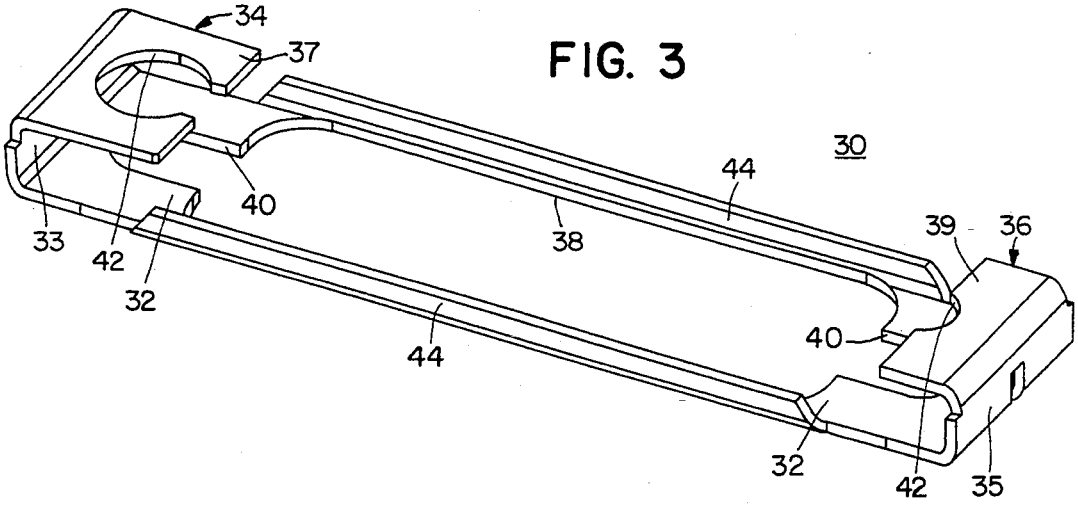
FIG. 3 is a perspective view of a slide latch which the holding device incorporates to form as one unit.

Referring to FIG. 3, a standard slide latch 30 formed by a blank, has an elongated plate 32 and a large and a small U-shaped sections 34, 36 respectively positioned at two opposite ends thereof. Each U-shaped section 34, 36 has an end wall 33, 35 vertically integrally extending from the outermost edge of the plate 32 and a horizontal upper wall 37, 39 integrally extending horizontally and inwardly from the top of the end wall 33, 35 in parallel to the plate 32. The plate 32 has a central opening 38 extending therein along its lengthwise direction in its center portion, and two grooves 40 further respectively extending from the central opening 38 to the opposite ends of the plate 32. In vertical alignment with the respective groove 40, each upper wall 37, 39 has a cavity 42 therein wherein the cavity 42 is open to the central portion of the slide latch 30 in the horizontal direction. A pair of side walls extend vertically from two side edges of the plate 30. It can be understood that the slide latch 30 is the prior art standard component, and the above illustration is only to incorporate the following description for better understanding how and what the subject holding device 10 cooperates with.

Figure 4:
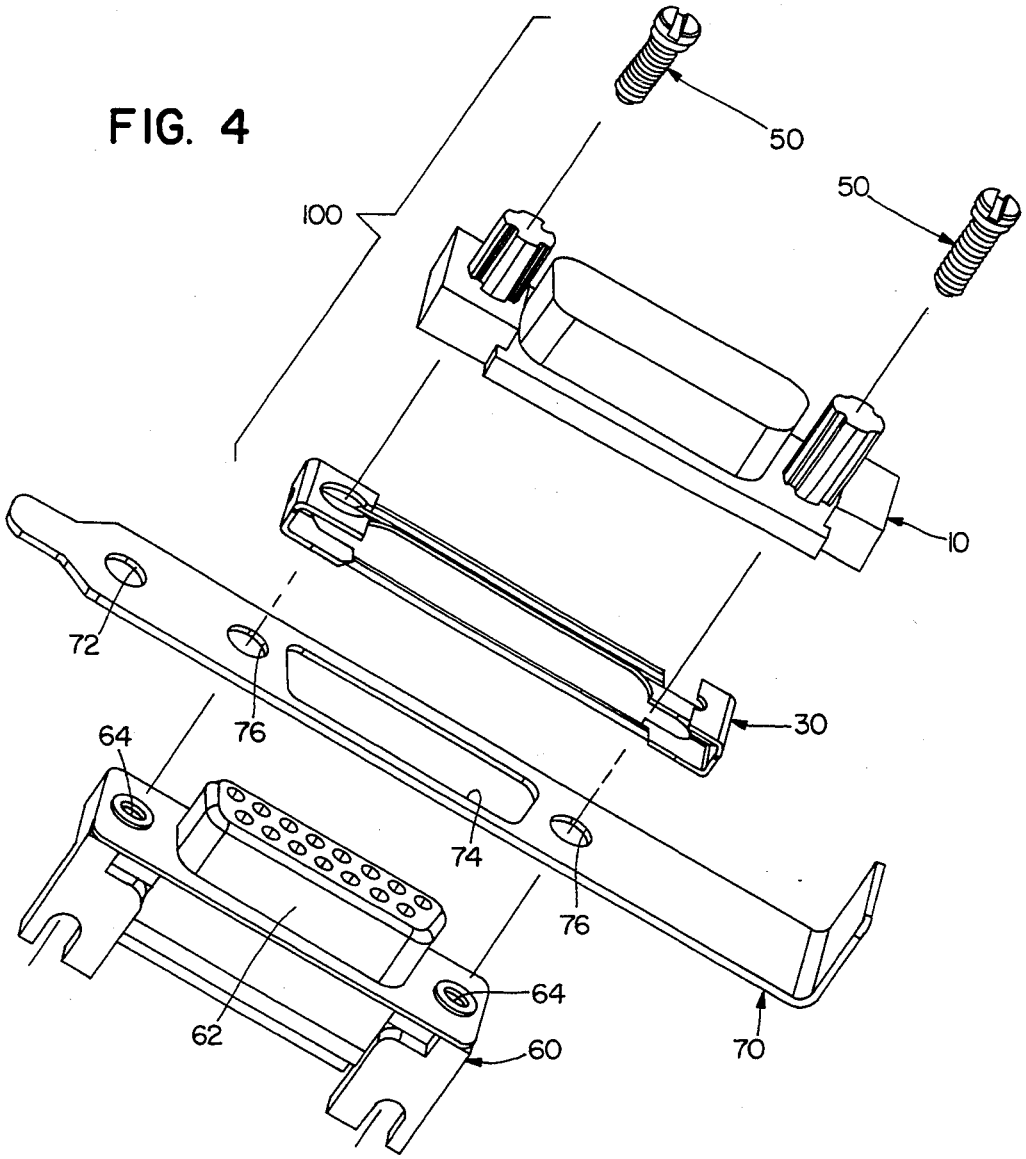
FIG. 4 is an exploded view of the holding device of FIG. 1, the screws, the slide latch of FIG. 3, the bracket and the I/O connector to show the relationship thereamong.

Referring to FIG. 4, the slide latch 30 can be inserted into the interior of the holding device 10 from the bottom. The plate 32 and the side walls 44 of the slide latch 30 can be completely received within the interior of the base 12 of the holding device 10. Similarly, the platforms 14 and 16 of the holding device 10 cover the U-shaped section 34 and 36 of the slide latch 30, respectively. In this situation, the plate 32 of the slide latch 30 is generally flush with the bottom surface of the holding device 10; in other words, the slide latch 30 is totally enclosed in the holding device 10. It can be appreciated that because the holding device 10 is made of plastic and the slide latch 30 is made of resilient metal, the holding device 10 can, by its resilience, hold the slide latch 30 in position in an interferential engagement therebetween.

Figure 2A:
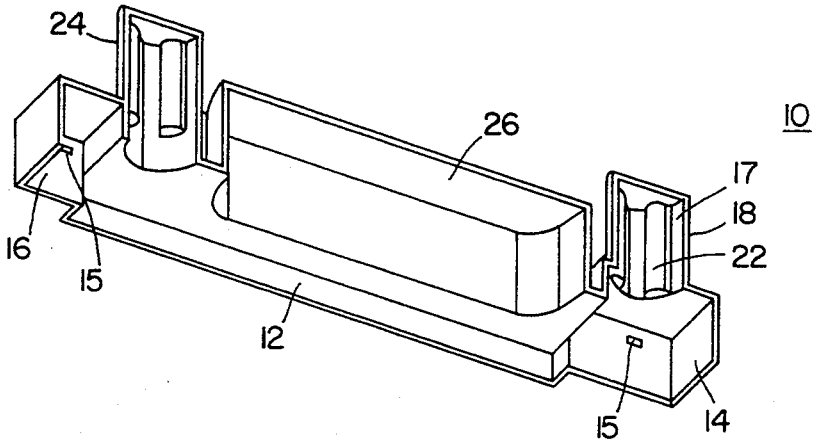
FIG. 2(a) is an alternate embodiment of the holding device to show the dimple structure in the interior of the platform of the holding device of FIG. 1.

It is also understood that as shown in FIG. 2(A), alternately, two pairs of dimples 15 can be formed in the interior of the raised platforms 14 and 16, respectively, for respective retainable engagement with the U-shaped sections 34 and 36 for holding the slide latch 30 in the holding device 10.

Successively, the tip of each post 18, 24 has been cut off, so the post 18, 24 become a through-tube and the interior of the post 18, 24 is exposed to the exterior. Two screws 50 is forcefully inserted into the interior of the posts 18 and 24 of the holding device 10 from the top, respectively, until the screw nut of each screw 50 is flush with the top edge of the cut post 18 or 24. The ribs 22 in the interior of the post 18, 24 can retain the corresponding inserted screw 50 therein in an interference fit. The two screws 50 are respectively aligned with the grooves 40 in the plate 32 of slide latch 30 in the vertical direction. Therefore, the holding device 10, the slide latch 30 and two screws 50 can be pre-assembled as one unit under the condition that the slide latch 30 and the screws 50 are totally enclosed within the interior of the holding device 10. Such unit is easy and convenient for shipping.

Still referring to FIG. 4, when such unit 100 is shipped to and obtained by an operator of a computer manufacturer, the operator can easily, by one hand, hold such unit 100 including the holding device 10, the slide latch 30 and two screws 50. Generally in this occasion, the I/O connector 60 has been mounted on a card or board which is retained in a slot structure within the computer case. Also, a bracket 70 has been fastened to the backpanel (not shown) by a screw (not shown) extending through the fastening screw hole 72. The protrusion portion 62 of the connector 60 extends through the D-shaped opening 74 of the bracket 70, and the screw holes 64 of the connector 60 are respectively aligned with the corresponding screw holes 76 of the bracket 70.

Therefore, the operator can conveniently hold the pre-assembled unit 100 by his left hand and let the positioned screws 50 respectively aligned with the corresponding screw hole 76 and 64 of the bracket 70 and the connector 60 in the vertical direction, and use his right hand to fasten the screws 50 thereto by a screw driver for uniting the unit 100 (including the holding device 10 and the slide latch 30), the bracket 70 and the connector 60 together. It can be seen that the protrusion portion 62 of the connector 60 extends through the central opening 38 in the slide latch 30 when the unit 100 is put on the bracket 70, and the screws 50 respectively extend through the grooves 40 when they are fastened to the corresponding holes 76, 64 of the bracket 70 and the connector 60. Because the bracket 70 has already been fastened to the backpanel of the computer case, the unit 100 attached to the bracket 70 can be deemed to be fixed on the backpanel of the computer case. This assembling is easier and more operable than the traditional method which lacks the subject holding device 10 to join the separate slide latch and screws together as one unit for easy holding and assembling.

The unit 100 which has been attached to the computer backpanel (bracket 70), can be kept in such situation without removing the holding device 10 therefrom until a complementary connector of a peripheral is about to be connected to the I/O connector 60. During such period, such holding device 10 can function as a dust-cover to protect the protrusion portion 62 which extends out of the central opening 38 of the slide latch 30. When a complementary connector is intended to mate with the I/O connector 60, the slide latch 30 and the I/O connector 60 can be exposed by withdrawal of the holding device 10 therefrom for mating with such complementary connector of the peripheral.

Figure 5:
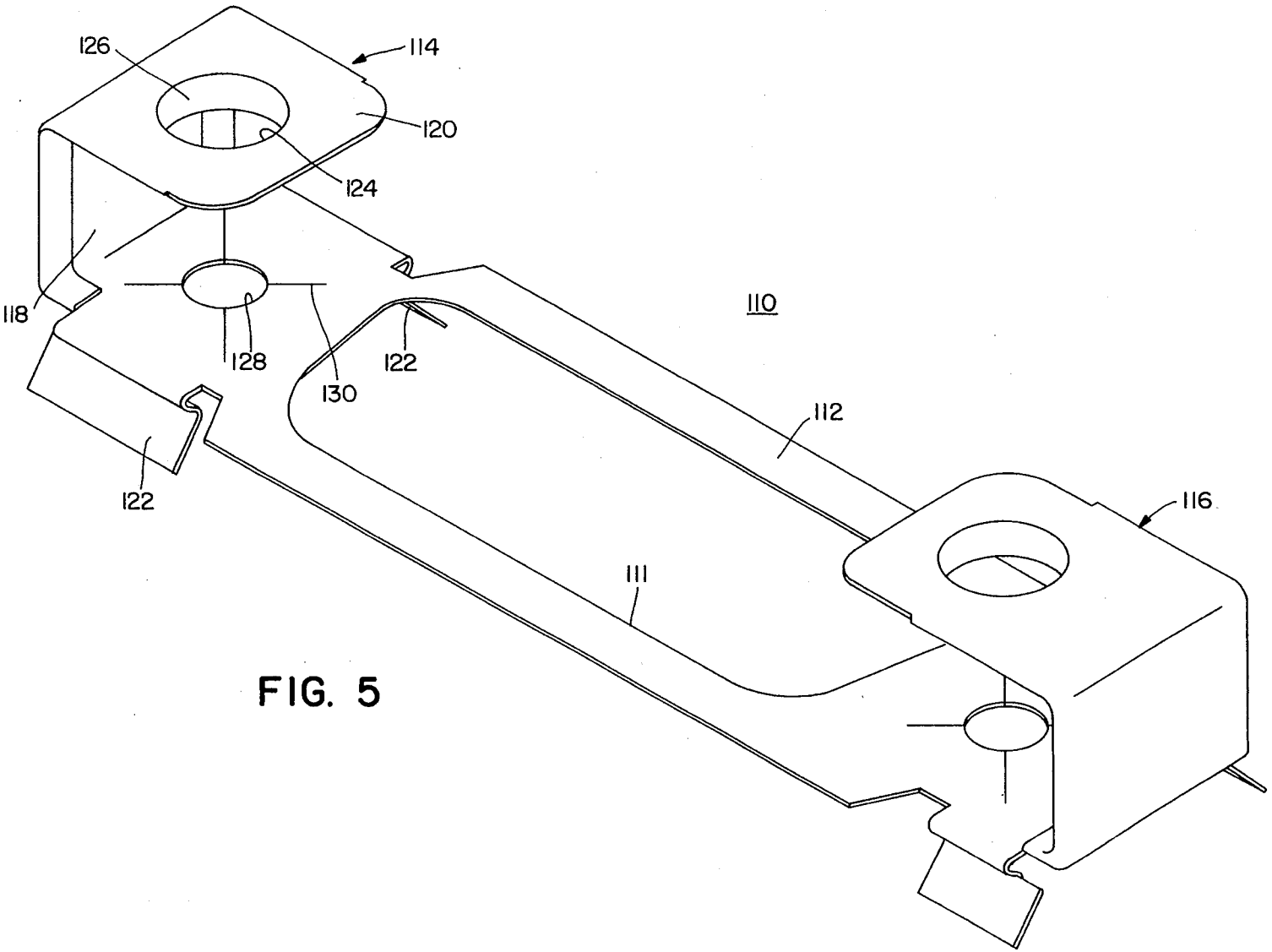
FIG. 5 is a perspective view of a holding device of another embodiment according to the present invention.

FIG. 5 illustrates another embodiment of the holding device in this invention. Different from the holding device 10 of the previous (first) embodiment, the holding device 110 in this (second) embodiment is made of a metal sheet by stamping and forming. Such holding device 110 includes an elongated base 112 having a central opening 111 therein, and a small and a large lying U-like raised platforms 114 and 116 positioned at two opposite ends of the base 112, respectively. The small platform 114 includes an end wall 118 vertically extending from the outermost edge of the base 112, and a horizontal section 120 extending horizontally and inwardly from the top of the end wall 118. The end wall 118 incorporating the horizontal section 120 and the adjacent end portion of the base 112 forms the generally U-shaped platform 114. A pair of grasp means or clips 122 are formed at the two sides of the base 112 under the platform 114. A large hole 124 is positioned in the horizontal section 120 of the small platform 114 in a vertical direction wherein a circumferential flange 126 integrally extends downward from the periphery of the hole 124. Oppositely and correspondingly, a small hole 128 is positioned in the base 112 in alignment with the large hole 124. Four radial slits 130 are positioned around the periphery of the small hole 128 at equal intervals. Similarly, the large platform 116 has the like structures as shown in the figures and is not illustrated in detail hereafter.

Figure 6A:
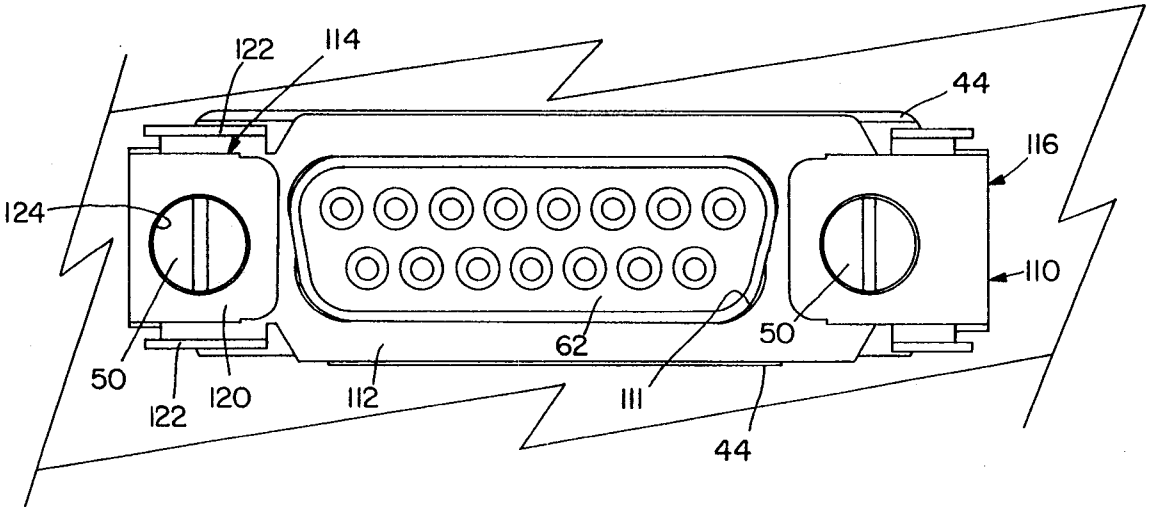
FIG. 6(A) is a front view of the holding device of FIG. 5, with a slide latch, attached to the I/O connector.
Figure 6B:
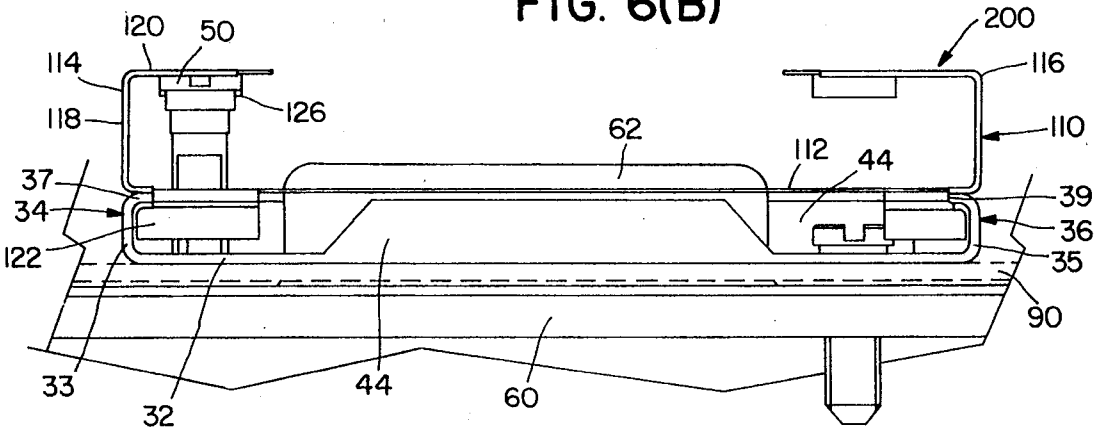
FIG. 6(B) is a side view of the I/O connector, the backpanel, the slide latch and the holding device of FIG. 6(A), to show the structural relationship thereamong.
Figure 7:
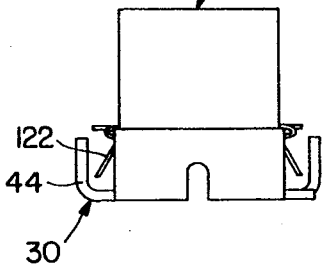
FIG. 7 is a side view of the holding device of FIG. 5 and the slide latch of FIG. 6(A) to illustrate the attachment therebetween.

As shown in FIGS. 6(A), 6(B) and 7, when assembling, the holding device 110 is attached to the slide latch 30, which is similar to that in FIG. 3 from the top, and the clips 122 can retain the slide latch 30 in position thereunder. Successively, a screw 50 is inserted into and through the large hole 124 from the top, and continuously confronts the small hole 128 thereunder. Because the diameter of the screw 50 is a little larger than that of the small hole 128, the downward movement of the screw 50 will expand the dimension of the small hole 128 by deflecting the peripheral portion of the base 112 around the small hole 128 outwardly by mean of the structure of such slits 130. This provides a retention function to the screw 50. The screw 50 can be installed into the holding device 110 until the nut of the screw 50 is generally flush with the horizontal section 120 of the holding device 110. In this situation, the screw nut is conformably received within the flange 126 of the holding device 110 and the tip of the screw 50 projects out of the slide latch 30 a little bit, as shown in FIG. 6(B). Similarly and oppositely, another screw 50 also can be retained in the same condition in the holding device 110 and the associated slide latch 30.

Similar to the holding device 10 in the first embodiment, the holding device 110 also is joined with the slide latch 30 and two screws 50 as one unit 200 for easy shipping and handling. Referring to FIGS. 6(A) and 6(B), such unit 200 can be held by one hand in alignment with the corresponding I/O connector 60 and the backpanel 90 for assembling. It can be understood that in FIG. 6(B), the right screw 50 has been fasten to the connector 60 for assembling, and the left screw 50 is still in its original position before assembling for better understanding the before-and-after situation of the unit 200. It can be seen that when assembled, the screw 50 is totally moved from the holding device 110 and the nut of the screw 50 abuts against the slide latch 30. Different from the holding device 10 in the first embodiment, the holding device 110 does not function as a dust-cover and might be discarded as soon as the slide latch 30 has been fastened to the I/O connector 60 and/or the backpanel 90 by the screws 50.

While the present invention has been described with reference to a few specific embodiments, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A holding device for use with a slide latch in an electrical connector comprising:

an elongated base;

a first and a second platforms positioned at two opposite ends of the base;

a first post extending upward from the first platform;

a second post extending upward approximate the second platform; and an island extending upward from the base wherein the whole holding device is in a form of a mask having a hollow interior, and is completely open to an exterior at its bottom, so that said slide latch can be loaded to the holding device from the bottom and be retained within said hollow interior of the holding device as one unit for convenient shipping and easy holding during assembling, and wherein a screw is retainably received within a retaining hole defined by each post of the holding device.

2. The holding device as described in claim 1, wherein a plurality of ribs are formed in an interior of each post of the holding device for interferential engagement with the corresponding inserted screw.

3. The holding device as described in claim 1, wherein a plurality of dimples are formed in the interior of the holding device for holding the loaded slide latch in position.

4. The holding device as described in claim 1, wherein a cavity in the island can conformably receive the protrusion portion of an I/O connector and two posts are in alignment with screw holes of said connector fastened to a backpanel of a computer case.

5. The holding device as described in claim 4, wherein said holding device functions as a dust-cover.

6. The holding device as described in claim 1, wherein the holding device is made of plastic by vacuum forming and retains the slide latch therein by its resilience.

7. A pre-assembled unit for use with an I/O connector in Local Area Network, comprising:

a holding device including a base and two platforms at two opposite ends thereof;

a slide latch temporarily attached to said holding device; and a pair of retaining holes positioned approximate said two platforms, respectively, wherein a pair of screws are retained in the retaining holes of said holding device, respectively, and each screw is in alignment with a corresponding screw hole of said I/O connector, and the slide latch is sandwiched between the holding device and said I/O connector when said unit is assembled to said I/O connector.

8. The pre-assembled unit as described in claim 7, wherein said two platforms are higher than the base.

9. A pre-assembled unit for use with an I/O connector in Local Area Network, comprising:

a holding device including a base and two platforms at two opposite ends thereof;

a slide latch temporarily attached to said holding device; and a pair of retaining holes positioned approximate said two platforms, respectively, wherein said holding device is made of plastic and has a hollow body, and said holding device includes two posts respectively positioned approximate two platforms and respectively defining said pair of retaining holes therein for respectively retaining a pair of screws therein, and a central cavity in the base for receiving a protrusion portion of said I/O connector.

* * * * *